US006158653A

United States Patent [19]

Kanter et al.

[11] Patent Number: 6,158,653

[45] Date of Patent: Dec. 12, 2000

[54] CONTAINER HAVING IMPROVED STACKING STRENGTH

[75] Inventors: Allen Kanter, 1042 Gypsy Hill Rd., Gwynedd Valley, Pa. 19437; Andy Sypawka, Collegeville, Pa.

[73] Assignee: Allen Kanter, Gwynedd Valley, Pa.

[21] Appl. No.: 09/452,560

[22] Filed: Dec. 1, 1999

Related U.S. Application Data

[60] Provisional application No. 60/119,392, Feb. 10, 1999.

[51] Int. Cl.[7] ..... B65D 5/56

[52] U.S. Cl. ..... 229/185.1; 229/120.11; 229/918

[58] Field of Search ..... 229/120.11, 120.18, 229/185.1, 918, 919

[56] References Cited

U.S. PATENT DOCUMENTS

| | | | |
|---|---|---|---|
| 2,572,387 | 10/1951 | Rayburn | 229/185.1 |
| 3,162,351 | 12/1964 | Rudofski | 229/918 |
| 3,667,666 | 6/1972 | Pryor | 229/185.1 |
| 4,056,223 | 11/1977 | Williams | 229/918 |
| 5,125,568 | 6/1992 | Bauer | 229/918 |
| 5,413,276 | 5/1995 | Sheffer | 229/120.11 |
| 5,524,815 | 6/1996 | Sheffer | 229/120.18 |
| 5,826,728 | 10/1998 | Sheffer | 229/120.11 |
| 5,839,650 | 11/1998 | Sheffer | 229/919 |
| 5,996,885 | 12/1999 | Chu | 229/918 |

*Primary Examiner*—Gary E. Elkins
*Attorney, Agent, or Firm*—Synnestvedt & Lechner LLP

[57] ABSTRACT

A container having an internal corner support for increasing the stacking strength of the container. The container has multiple wall panels. The internal corner support includes first and second panel sections attached pivotally to one another and which are adjacent a corner of the container for providing additional stacking support.

20 Claims, 9 Drawing Sheets

CONTAINER HAVING IMPROVED STACKING STRENGTH

CROSS-REFERENCE TO RELATED APPLICATION

This application claims the benefit of U.S. Provisional Application No. 60/119,392 filed Feb. 10, 1999.

BACKGROUND OF THE INVENTION

1. Field of the Invention

The present invention pertains to containers and boxes used for packaging, shipping, and displaying goods. More particularly, the invention relates to display containers having means to facilitate the stacking of such containers on top of one another.

2. Description of the Related Art

Display containers are widely used for shipping and marketing products. Such containers are especially popular in warehouse-type marketing settings and supermarkets where many containers are opened to display the food or merchandise within and stacked one on top of another. Examples include containers of packaged candy which may be decorated for display purposes. The containers of candy are shipped to the store in stacked form. Store personnel remove any display panels to allow the candy within to be seen and removed, and the containers are then stacked one on top of another on the retail floor.

A major problem with previously known display containers is their lack of strength for stacking. All too often loaded and stacked containers collapse under the weight or become misshaped. This impairs the aesthetic appearance of the display sought by the seller and damages the products within.

Typical containers are made from a die cut piece of single layer corrugated paperboard. Such construction has proven unsatisfactory for display use where removal of the top and any display cutout weakens the container sidewalls which bear the weight of a stacked group of containers. Collapse and/or warping results.

Methods of producing stronger containers are known. For example, double walled corrugated containers are stronger than single walled corrugated containers. This added strength, however, adds additional manufacturing costs and creates more waste product for eventual disposal. Moreover, because the container is formed from a single die cut piece of corrugated paperboard, all parts of the container will be made of the double layer board, including the bottom forming panels which do not always need the added strength. This wastes natural resources consumed to make the container and adds unnecessary manufacturing costs.

Accordingly, one object of the present invention is to provide a stronger display-ready container.

Another object is to provide a stronger container that is economical to produce.

A further object of the present invention is to provide a stronger container that is easy to assemble and use.

Another object is to provide a container that can be safely stacked during shipping and display.

A still further object is to provide a stronger stackable container that is assembleable from a knockdown state.

Additional objects, advantages and novel features of the invention will be set forth in part in the description which follows, and in part will become apparent to those skilled in the art upon examination of the following, or may be learned from making and using the invention. The objects and advantages of the invention may be realized and attained by means of the combinations pointed out in the appended claims.

SUMMARY OF THE INVENTION

The objects and advantages of the present invention are obtained by providing a container having a corner support. The container includes first, second, third and fourth wall panels which have an inner face and a top edge. The first and second wall panels are attached to one another at a first corner, the second and third wall panels are attached to one another at a second corner, the third and fourth wall panels are attached to one another at a third corner, and the first and fourth wall panels are attached to one another at a fourth corner. A glue panel is attached to the inner face of the first wall panel, and a second glue panel is attached to the inner face of the second wall panel. The corner support includes first and second panel sections adjacent the first corner for increasing the stacking strength. The first panel section has a first edge attached pivotally and integrally to the glue panel and has a second edge opposite the first edge. The second panel section has a first edge pivotally attached to the second glue panel and a second edge opposite the first edge which is attached pivotally and integrally to the second edge of the first panel section. This provides an additional support in the corner of the container, preferably spaced from the corner of the container, to provide additional support for containers stacked on top.

The first and second panel sections can be configured for use with a container that has a knockdown state. Here the first and second panel sections move automatically into their desired positions upon assembly of the knockdown into the final container form.

BRIEF DESCRIPTION OF THE DRAWINGS

The foregoing summary and the following detailed description may be better understood when read in conjunction with the accompanying drawings. Various embodiments are shown for the purpose of illustrating the invention. It is understood, however, that this invention is not limited to the precise arrangements shown.

DETAILED DESCRIPTION

Figure 1:
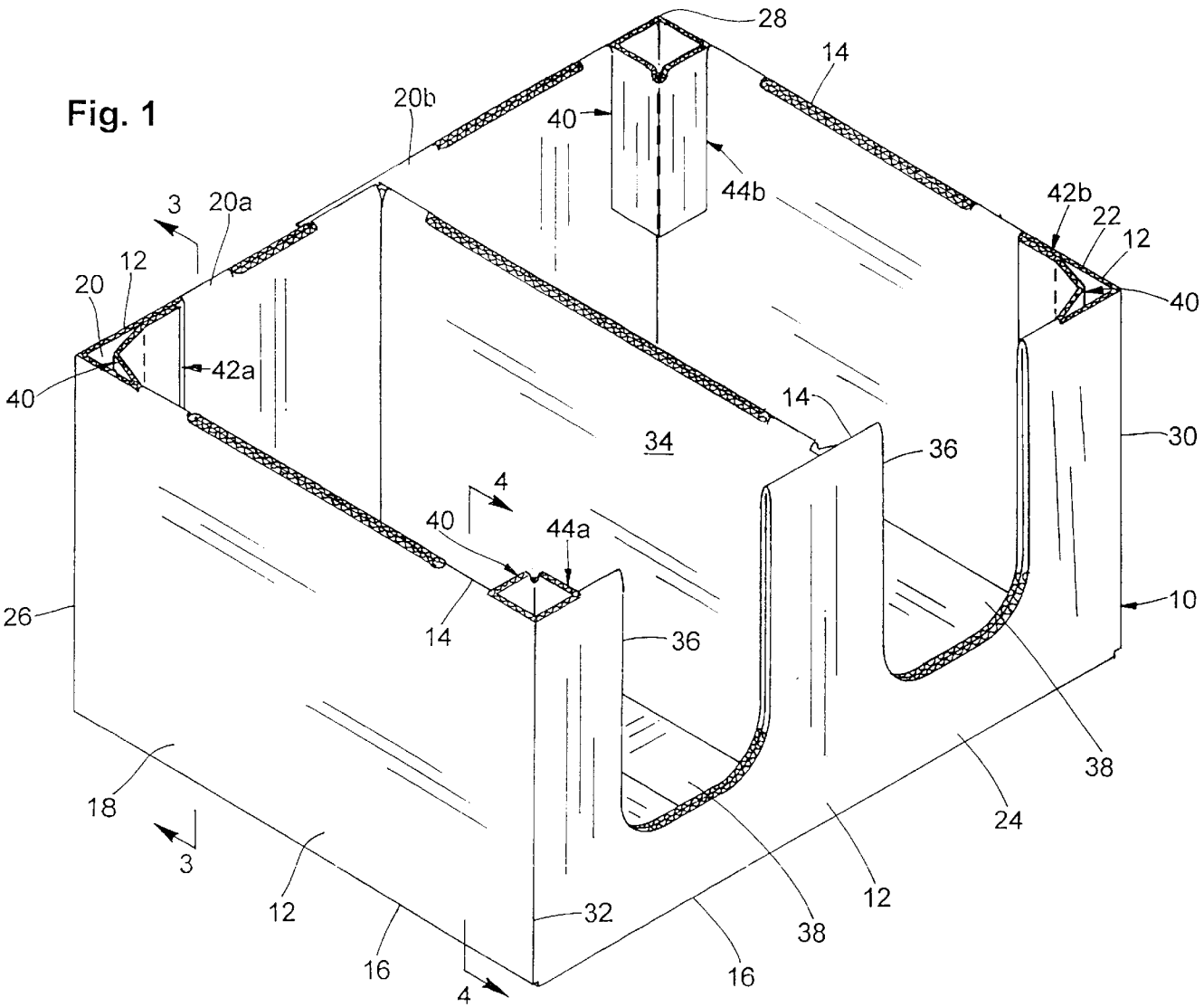
FIG. 1 is a perspective view of a container made in accordance with the present invention.

The invention disclosed herein is for a container having a novel means of strengthening for stacking. Described below are preferred embodiments particularly suited for display-ready containers. It is recognized, however, that the present invention is adaptable to containers used for other purposes.

Illustrated with reference to FIGS. 1, 2, 3, and 4 is a display ready container 10 for shipping and displaying goods. The container 10 has multiple wall panels 12 integrally attached to one another to form the container sides. Each wall panel 12 has a top end 14 and a bottom end 16 and an inner face 17 as shown. In this particular example the multiple wall panels 12 include a first wall panel 18, a second wall panel 20, a third wall panel 22, and a fourth wall panel 24. The second wall panel 20 is formed from two partial panels 20*a*, 20*b* glued together during the manufacturing process in a manner known in the art.

The first and second wall panels 18 and 20 are attached at a first corner 26; the second and third wall panels 20 and 22 at a second corner 28; the third and fourth wall panels 22 and 24 at a third corner 30; and the fourth and first wall panels 24 and 18 at a fourth corner 32.

A divider wall 34 is integrally attached to an end of the partial wall panel 20*a* and adhesively attached to the fourth wall panel 24 to divide the container 10 into two sections as shown. Two display openings 36 provide visual display and access to the two sections formed by the divider wall 34.

Integrally attached along the bottom end 16 of the side wall panels 12 is a bottom formed by multiple bottom flaps 38. Partial bottom flaps 38*a* and 38*b* integrally attached to partial wall panels 20*a*, 20*b* respectively, form the bottom flap 38 attached to the wall panel 20 (See FIG. 6). Many different types of container bottoms are known in the art, any suitable bottom may be used.

As best illustrated in FIGS. 1, 2, 3, and 4, corner supports 40 are provided adjacent each corner 26, 28, 30, and 32 to improve stacking strength. The corner supports 40 reinforce each of the corners 26, 28, 30, and 32 and provide a second support surface in addition to the tops of the corners for supporting a container stacked on top. While all corners of the container 10 are shown with a corner support 40, it is readily understood that other embodiments having less than all corners reinforced are possible.

Figure 5:
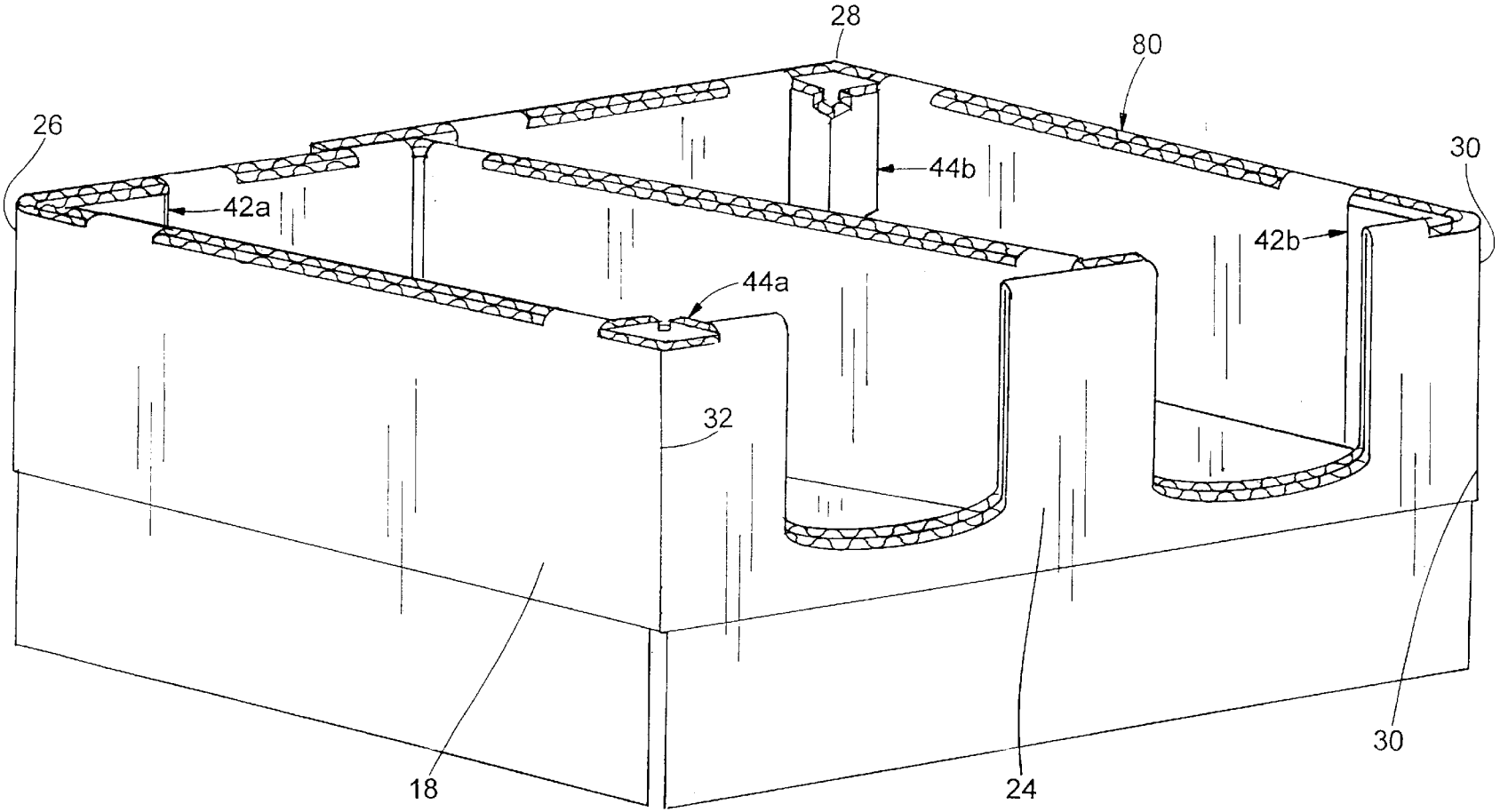
FIG. 5 is a perspective view of the container of FIG. 1 in its knockdown state shown partially opened.
Figure 5A:
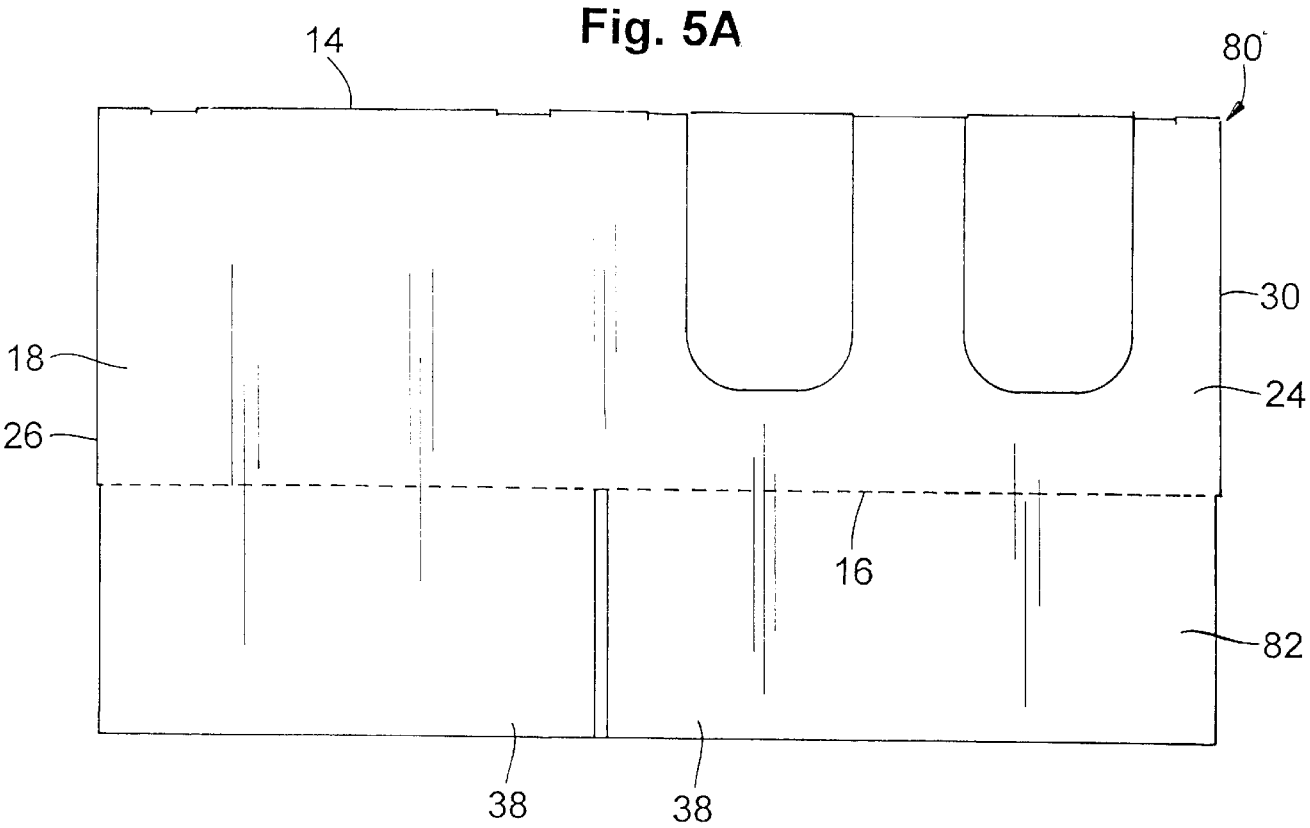
FIG. 5A is a side view of the container in its knockdown state.
Figure 5B:
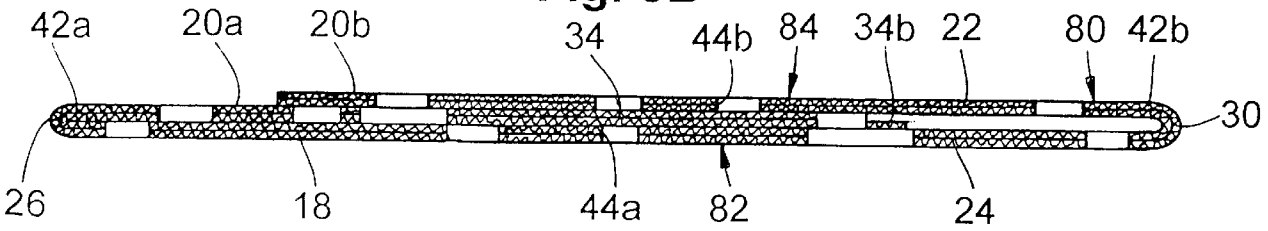
FIG. 5B is a top view of the knockdown shown in FIG. 5A.

Multiple configurations for the corner supports 40 are contemplated, two particular preferred configurations being illustrated: a substantially non-rectangular corner support 42*a*, 42*b*, and a substantially rectangular corner support 44*a*, 44*b*. As further discussed below, the container 10 has a knockdown or collapsed state 80 as seen in FIGS. 5A and 5B ideal for shipping stacked empty containers. The particular corner supports 42*a*, 42*b*, 44*a*, 44*b* are preferred for this type of container 10 since they automatically extend into the positions shown in FIG. 1 upon assembly of the container from the knockdown state. This feature is discussed below with further description of the corner supports 40.

Figure 3:
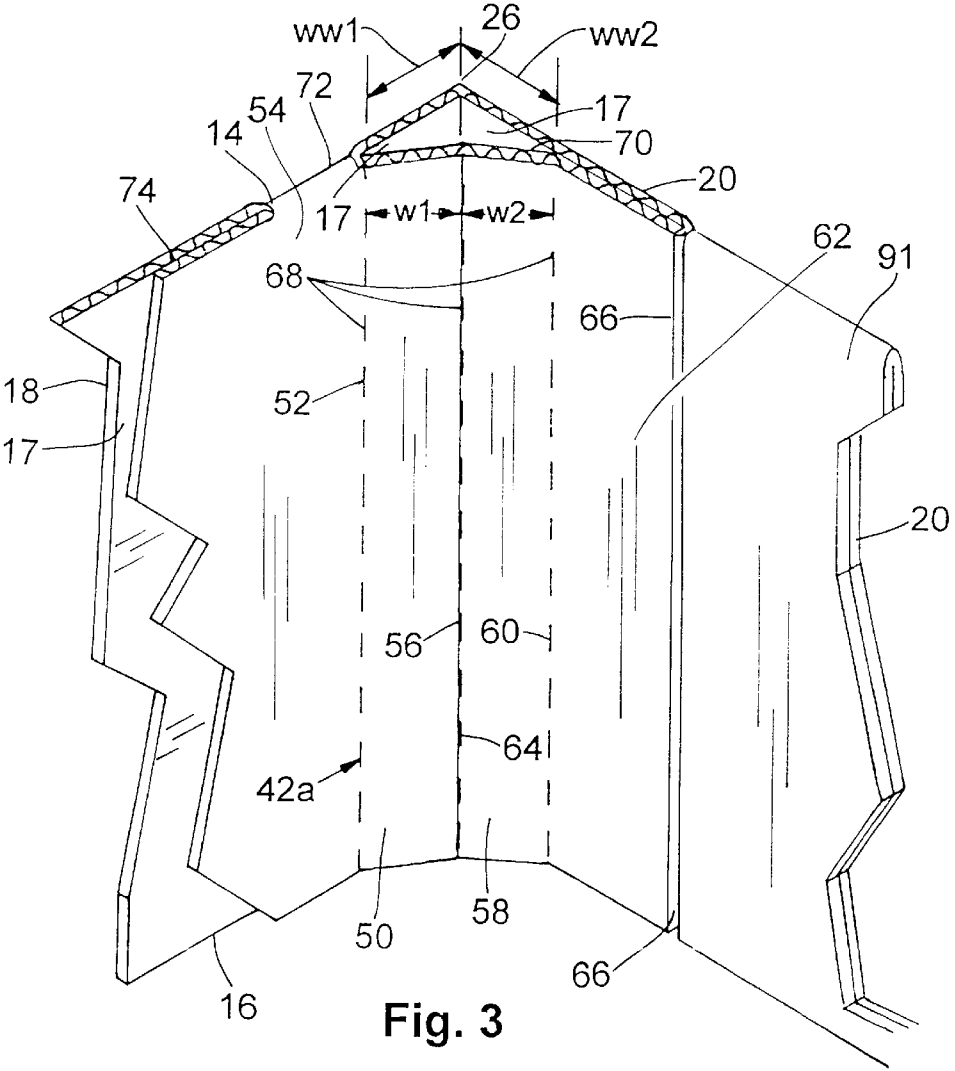
FIG. 3 is an enlarged sectional view taken along line 3—3 of FIG. 1.

With reference to FIGS. 1 and 3, the corner support 40 of the non-rectangular type 42*a*, 42*b*, has a first panel section 50 having a first edge 52 attached pivotally to the inner face 17 of the first wall panel 18 between the first and fourth corners 26 and 32 respectively. In this embodiment, the first edge 52 is attached pivotally to the inner face 17 by a glue panel 54 which is adhesively attached to the inner face 17 of the first wall panel 18, preferably with an adhesive. The glue panel 54 is integrally attached to the top end 14 of the first wall panel 18 and folded thereover onto the inner face 17 of the wall panel 18 and adhesively attached thereto with glue. The first panel section 50 of this embodiment is thus formed as an integral extension of the glue panel 54. The first panel section 50 further has a second edge 56 which is opposite the first edge 52.

A second panel section 58 has a first edge 60 attached pivotally to the inner face 17 of the second wall panel 20 between the first and second corners 26 and 28. In a like manner as with the first panel section 50, the second panel section 58 is attached pivotally to the inner face 17 through a second glue panel 62 which is adhesively attached to the wall panel 20. The second panel section 58 further has a second edge 64 opposite the first edge 60 and attached pivotally to and contiguous with the second edge 56 of the first panel section 50. As best seen in FIG. 3, the first panel section 50, the second panel section 58, and the second glue panel 62 are integrally connected to one another and formed as an integral extension from the first glue panel 54. This integral unit has an end 66 as shown. Fold lines 68, such as a line of perforations or a score, delineate the ends of the panel sections 50 and 58 and allows pivotal movement thereabout. Put another way, the internal support corners 42*a*, 42*b* are preferably formed of a unitary panel section having longitudinal fold lines 68 to delineate the various contiguous panels, i.e. the glue panel 54, the first panel section 50, the second panel section 58, and the second glue panel 66.

Preferably, the top edge 70 of both panel sections 50, 58 is co-elevational with the top end 14 of the wall panels 18, 20 to provide an additional support surface for a container stacked on top. The panel sections 50, 58 are also shown extending the full height of the wall panels 18, 20 from the bottom 16 to the top 14.

The first glue panel 54 can take the form of a reinforcing panel covering a substantial portion of the inner face 17 of the front wall panel 18 as shown in the figures. Such reinforcing is disclosed, for example, in U.S. Pat. No. 3,731,873 which is hereby incorporated by reference. While such a large reinforcing panel offers added strength and works well with the illustrated embodiment, it is not required. The glue panel 54 could be smaller in width, although a suitable width for adequate gluing and strength should be maintained, e.g., the width of the second glue panel 62.

The top end 14, where the first glue panel 54 is integrally attached to the first wall panel 18, can be uncut as shown at 72, or cut as shown at 74 to reveal a cross section of both the wall panel 18 and glue panel 54 (both being corrugated as shown). A benefit of the cut sections 74 is that the wider edge formed by the cut can provide additional support surfaces for a container stacked on top.

With reference to FIG. 3, it is seen that the width "W1" of the first panel section 50 between the first edge 52 and second edge 56 along an outer face 76 (facing the corner 26) is less than the width "WW1" taken along the inner face 17 of the first wall panel 18 between the first edge 52 and the first corner 26. Likewise, the width "W2" of the second panel section 58 between the first edge 60 and the second edge 64 along the outer face 76 is less than the width "WW2" taken along the inner face 17 of the second wall panel 20 between the first edge 60 and the first corner 26. "W1" and "W2" are preferably substantially equal; "WW1" and "WW2" are likewise preferably substantially equal. The panel sections 50 and 58 are preferably sized and configured so that the center of the corner support 42*a* (edge 56) is spaced from respective corners 26 as shown.

Figure 2:
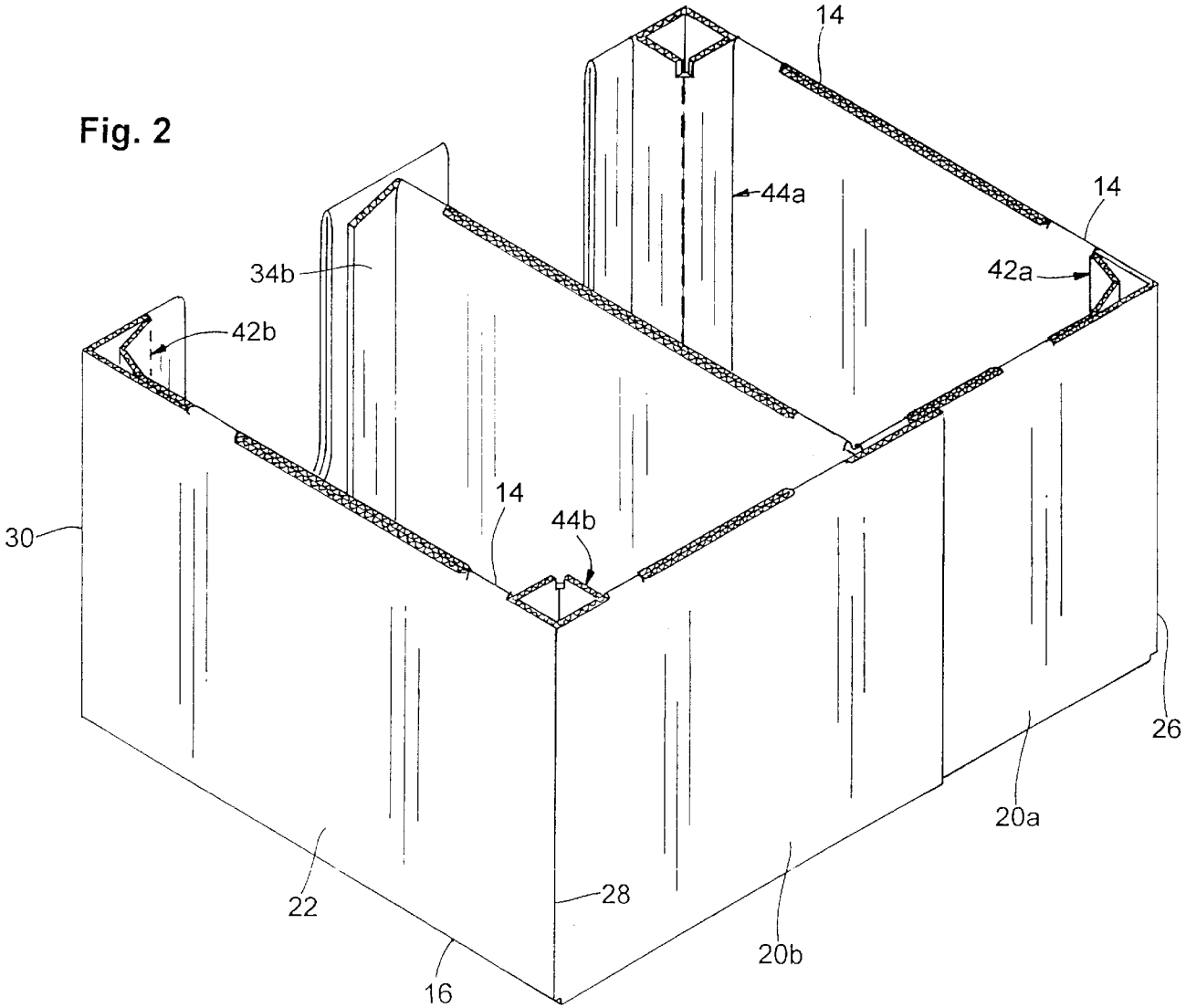
FIG. 2 is another perspective view of the container shown in FIG. 1.
Figure 4:
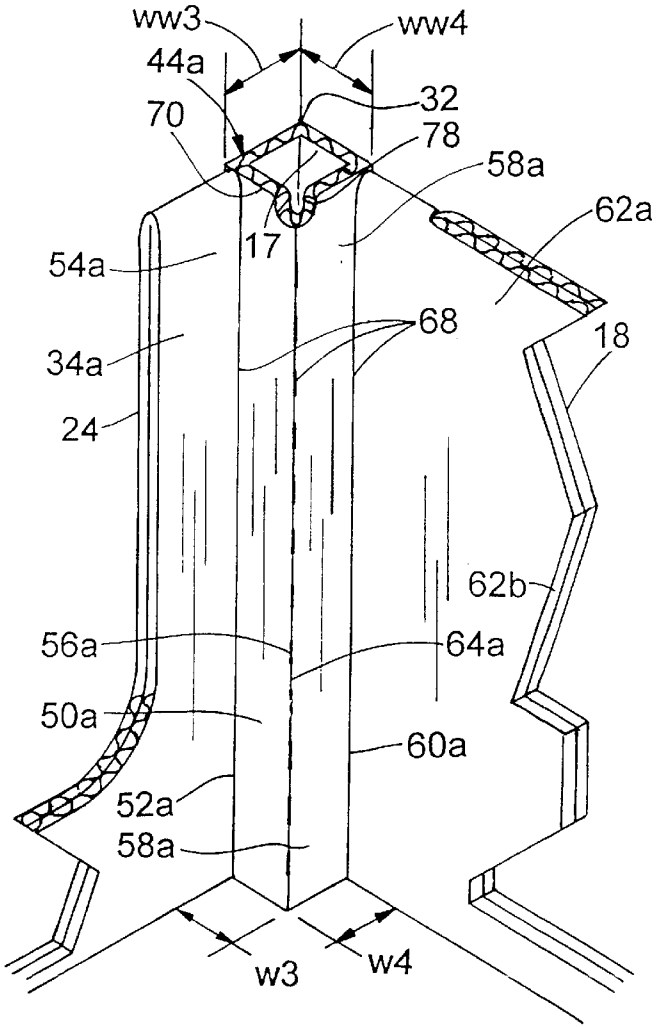
FIG. 4 is an enlarged sectional view taken along line 4—4 of FIG. 1.

The corner support 40 of the rectangular type 44*a*, 44*b* is now described with reference to FIGS. 1, 2 and 4. The rectangular corner support 44*a* has first and second panel sections 50*a*, 58*a*, each of the panel sections having respective first edges 52*a*, 60*a* as shown and respective contiguous second edges 56*a*, 64*a* pivotally and integrally connected to one another. The first edge 52*a* of the first panel section 50*a* is attached pivotally to the fourth wall panel 24 between the third and fourth corners 30, 32 respectively, through a first integrally and pivotally attached glue panel 54*a*; the first edge 60*a* of the second panel section 58*a* is attached pivotally to the first wall panel 18 between the fourth and first corners 32, 26 respectively through an integrally and pivotally attached second glue panel 62*a*. Unlike the non-rectangular corner supports 42*a*, 42*b*, both of the first and second glue panels 54*a*, 62*a* are integrally connected to the top end 14 of respective wall panels 24, 18. The top edge 70 of the panel sections 50*a*, 58*a* are co-elevational with the top end 14 of the wall panels 24, 18; the individual panel sections 50*a* 58*a* being defined by fold lines 68. The length of the panel sections 50*a*, 58*a* may extend the full height of the wall panels 12, or shorter as illustrated by corner support 44*b* in FIG. 1. The rectangular corner supports 44*a*, 44*b*, unlike the non-rectangular corners 42*a*, 42*b*, have a width "W3" and "W4" substantially equal to the respective widths "WW3" and "WW4" along the inner face 17 of the wall panels 24, 18 respectively between the edges 52*a*, 60*a* and the corner 32. This geometry is necessary for the knockdown state as further described below.

A further feature of the rectangular corner supports 44*a*, 44*b* is a tapered down shape 78 along the inside corner. This eliminates any sharp edges and prevents merchandise from getting caught on the corner edge when being dropped into the container 10 during loading.

The container 10 is preferably made from a unitary piece of single layer corrugated paperboard which is formed into a knockdown (collapsed) state 80 for easy stacking and shipment to the user. The term "knockdown" refers to the configuration of the container 10 in a flat unassembled form shown in FIGS. 5A and 5B (FIG. 5 showing the knockdown partially opened). The knockdown 80 has a first knockdown wall 82 and a second knockdown wall 84 attached to one another at the first and third corners 26 and 30. The first knockdown wall 82 includes the first and fourth wall panels 18 and 24, with the respective integral bottom flaps 38, in a substantially same plane, and the second knockdown wall 84 includes the second and third wall panels 20, 22 with respective integral bottom flaps in a second substantially same plane which is substantially parallel to the plane for the first knockdown wall 82. It is understood that the "substantially" same plane does not mean the exact same plane. The divider wall 34 is sandwiched between and substantially parallel to the knockdown walls 82 and 84.

Figure 6:
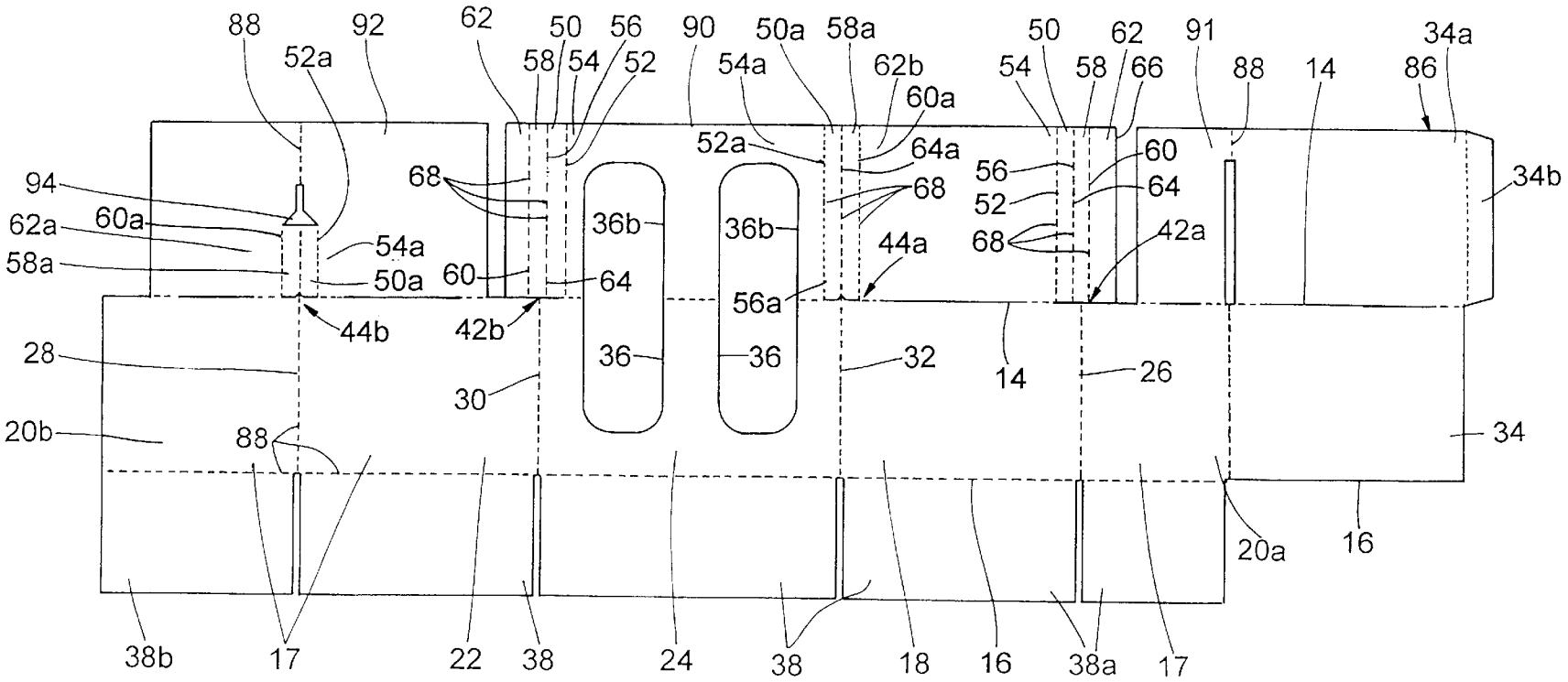
FIG. 6 is a plan view of a blank for forming the container shown in FIG. 1.

To assemble the knockdown 80 into the display ready container 10, the two knockdown walls 82 and 84 are pushed apart and folded to form the corners 32 and 28 and create the basic shape of the container 10 (see FIG. 6 showing the knockdown 80 partially opened). The container bottom flaps 38 are then folded.

Illustrated in FIG. 6 is a blank 86 for forming the knockdown 80 and the container 10. The blank 86 is preferably a unitary piece of material such as single layer corrugated paperboard die cut to form the configuration shown. The view of FIG. 5 shows the inner face 17 of the integrally attached wall panels 18, 20*a*, 20*b*, 22, and 24 with respective bottom flaps 38 integrally attached thereto. The divider wall 34 has an integrally connected reinforcing panel 34*a* having a glue tab 34*b*, and is attached to a reinforcing panel 91 which folds over the top end 14 to reinforce panel 20*a*.

For the non-rectangular corner support 42*a*, the first glue panel 54 (on the right side of the reinforcing panel 90), the first and second panel sections 50 and 58, and the second glue panel 62 are defined by perforated fold lines 68. The top end 14 of the wall panels 18 and 20 adjacent the first and second panel sections 50, 58 and second glue panels 62 is cut to allow pivotal movement about the first edge 52 of the first panel section 50. The non-rectangular corner support 42*b* is likewise constructed.

The rectangular corner support 44*a* has a first glue panel 54*a* which, in this embodiment, is in the middle of the reinforcing panel 90 which also serves as the first glue panel 54 for the non-rectangular corner support 42*b* on the left side of reinforcing panel 90. The reinforcing panel 90 also has display openings 36*b* conforming to display openings 36 on the fourth wall panel 24 to align therewith when folded about the top end 14. Viewing the corner support 44*a*, the first panel section 50*a* is integrally connected and separated by a perforated fold line 68 from the first glue panel 54*a*, followed by the second panel section 58*a*, in turn followed by the second glue panel 62*a* which here also serves as the first glue panel 62 for the non-rectangular corner support 42*a*. The reinforcing panel 90 is a single piece that forms the various panels for the non-rectangular corner supports 42*a*, 42*b* and the rectangular corner support 44*a*.

The rectangular corner support 44*b* is formed on a reinforcing panel 92 and has a slot 94 (cut out) which allows easy pop out of the corner support 44*b* during assembly from the knockdown 80 to the final container 10. Again, the present embodiment is shown with reinforcing panels 90, 92 which may not be necessary. Without such reinforcing panels, the various glue panels 54, 62 and 54*a*, 62*a*, could still be integrally connected to the top 14 of the wall panels, if desired, although smaller in width.

Figure 7:
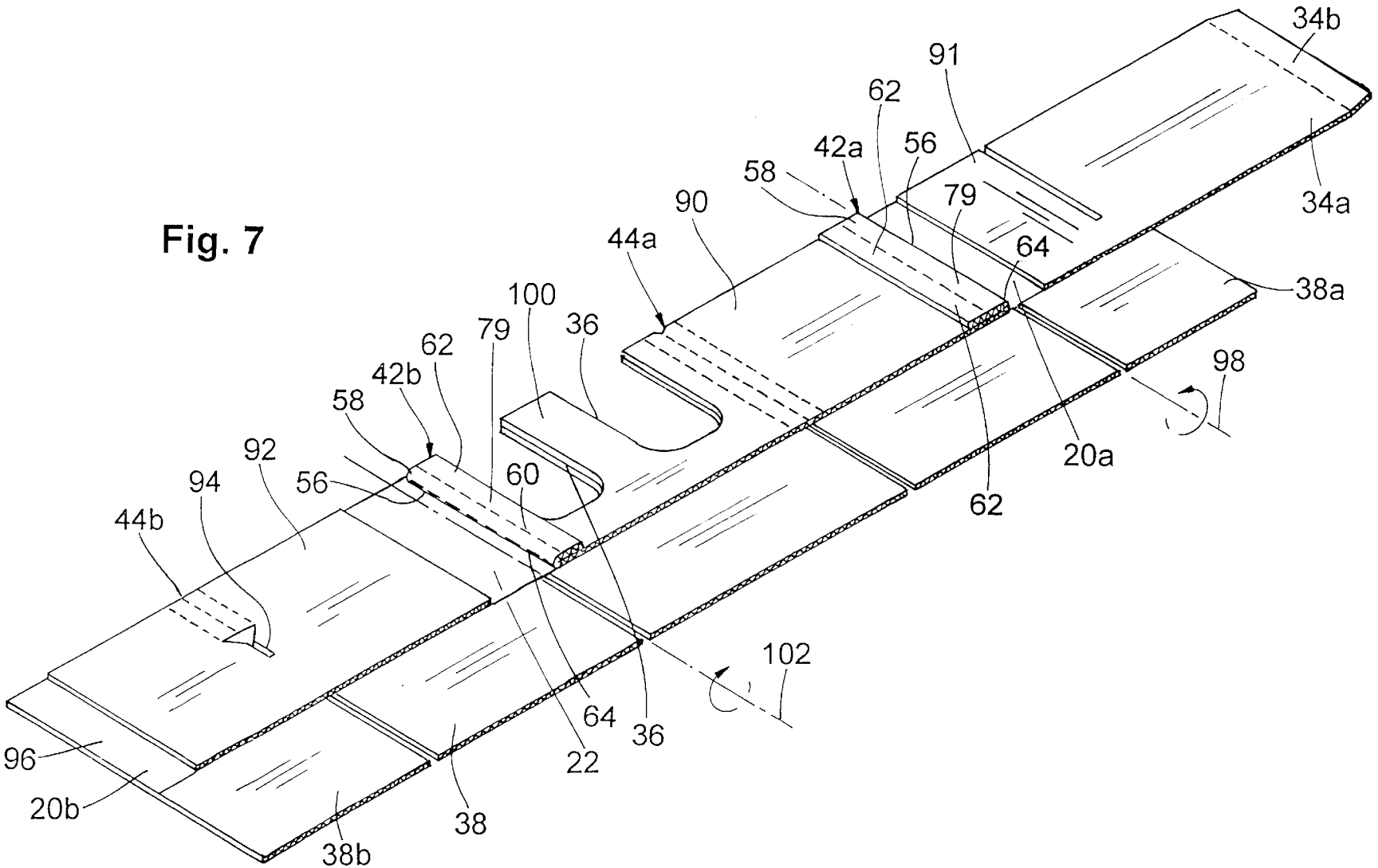
FIG. 7 is a perspective view of the blank of FIG. 6 shown partially assembled for forming the knockdown shown in FIGS. 5A and 5B.

The blank 86 can be assembled into the knockdown 80 and the final container 10 as now described with reference to FIGS. 5, 6 and 7. With the blank 86 in a flat position as shown in FIG. 6, the reinforcing panels 90 and 92 and divider reinforcing panel 34*a* (with reinforcing panel 91) are folded about the top end 14 and secured with glue to the inner face 17 of the respective wall panels 18, 20*a*, 20*b*, 22, 24 and divider panel 34. It is important not to glue the panel sections 50, 58 of the non-rectangular corner supports 42*a*, 42*b* and the panel sections 50*a*, 58*a* of the rectangular corner supports 44*a*, 44*b* as these must be free to pivot. Next, as shown in FIG. 7, for the non-rectangular corner supports 42*a* and 42*b*, the second panel sections 58 and second glue panel 62 are folded 180° as shown about the second edge 64 of the second panel section 58. The second edges 64 are offset from the corners 26 and 30 as shown in FIG. 6. Glue is then applied to the outer face 79 of the glue panel 62, the glue tab area 96 of wall panel 20*b*, and the glue tab 34*b*.

The wall panel 20*a* and divider panel 34 (with the reinforcing panels secured thereto) and the partial bottom flap 38*a* integrally attached thereto are then folded, all as a single flat unit about the line 98 as indicated (corner 26) onto the other panels (FIG. 7). The glue tab 34*b* of the divider reinforcing panel 34*a* is secured with the glue to the area 100 between the two display openings 36, and the second glue panel 62 of corner support 42*a* attached to the wall panel

20*a*. The wall panels 20*b* and 22 with reinforcing panel 92 secured thereto and respective bottom flaps 38 and 38*b* are then folded as a flat unit about line 102 (corner 30) and the glue tab 96 is secured with the glue to the back side of the partial wall 20*a* and the bottom partial flap 38*b* to partial bottom flap 38*a* to form the complete wall panel 20 and respective bottom flap, and the second glue panel 62 of the non-rectangular corner support 42*b* is secured to the wall panel 22. This forms a knockdown 80 which can be opened and assembled into the container 10 of FIG. 1.

With reference to FIG. 5, it is seen that the opening of the knockdown 80 to form the container 10 automatically extends the corner supports of both types 42*a*, 42*b*, and 44*a*, 44*b*. With respect to the non-rectangular corner supports 42*a*, 42*b*, it is seen that in the knockdown state the first and second panel sections 50 and 58 are folded face-to-face in a flat folded position (an angle of substantially 0 degrees between them) and sandwiched between the two knockdown walls 82, 84. Opening the knockdown, i.e., as the angle of corner 26 goes from 0° (knockdown) to 90° (FIG. 1), the panel sections 50, 58 extend away from the first corner 26 to form the polygon shape as seen in FIG. 1.

With respect to the rectangular corner support 44*a*, it is seen that in the knockdown state 80, the two panel sections 50*a*, 58*a* are in a substantially same plane relative to one another, (an angle of substantially 180 degrees between them) sandwiched between and substantially parallel to the first and second knockdown walls 82, 84. Opening the knockdown 80, the two panel sections 50*a* and 58*a* extend into the position shown in FIG. 4, extended from the corner and forming the rectangular shape as shown.

Figure 8:
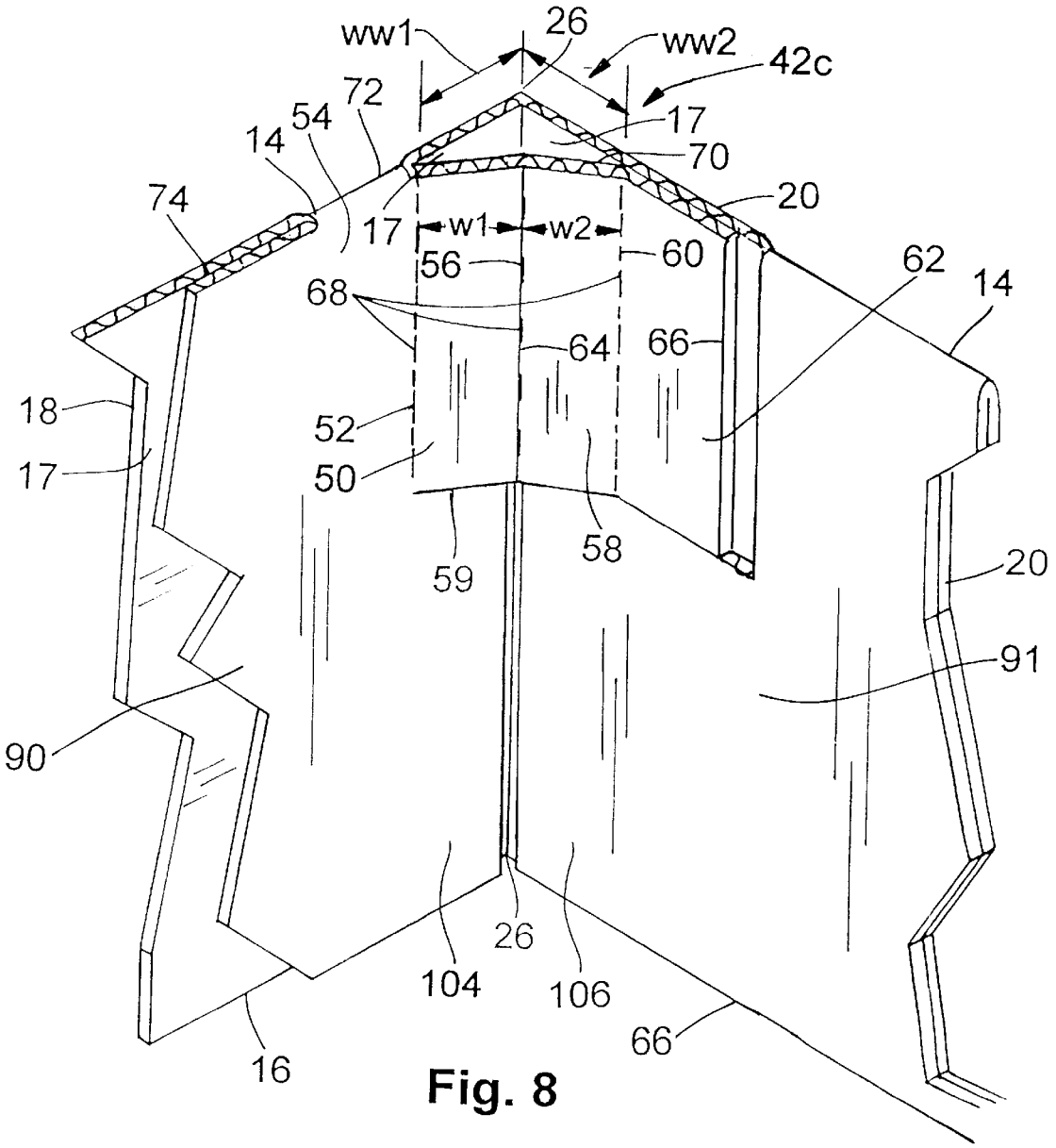
FIG. 8 is a perspective view of another embodiment of a container made in accordance with the present invention.
Figure 9:
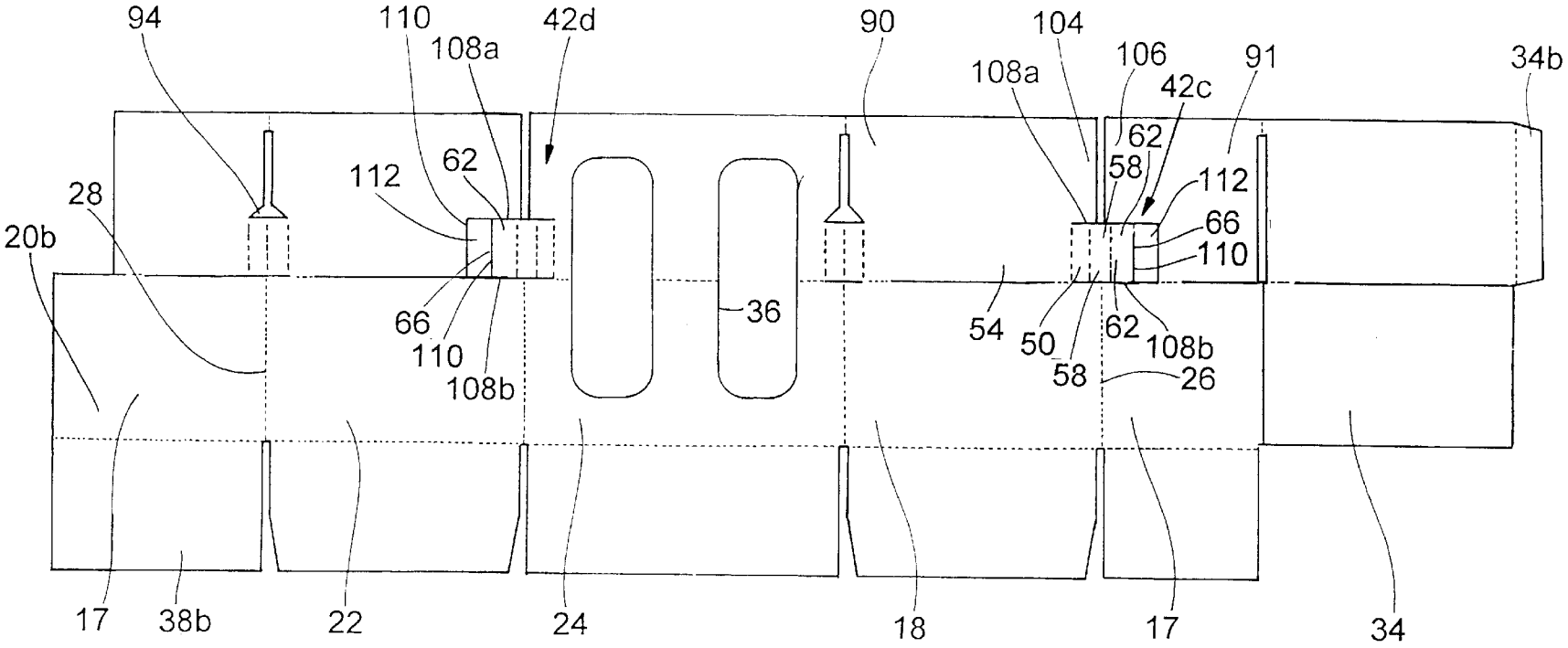
FIG. 9 is a plan view of a blank for forming the container shown in FIG. 8.

Illustrated in FIGS. 8 and 9 is another embodiment of the corner supports 40 of the non-rectangular type. A corner support 42*c* is similar to that of the support 42*a* of FIG. 3, with similar elements being referenced with the same reference number. The height of the first and second panel sections 50 and 58 of the corner support 42*c* are substantially less than the height of the adjacent wall panels 18 and 20, the corner support 42*c* having a lower end 59 as shown. The first edge 52 of the first panel section 50 is attached pivotally to the inner face 17 of the first wall panel 18 via the glue panel 54 in a like manner as shown and described with reference to FIG. 3. Here, however, the glue panel 54 has a lower section 104 that extends below the lower end 59 of the corner support 42*c* to the corner 26 (see FIG. 9). The first edge 60 of the second panel 58 is pivotally attached to the inner face 17 of the second wall panel 20 via the second glue panel 62. The reinforcing panel 91, folded over at the top end 14 and glued to the panel 20 has a lower section 106 that extends below the lower end 59 of the corner support 42*c* to the corner 26 (see FIG. 9).

With reference to FIG. 9, it is seen that the corner support 42*c* is formed and cut from the first glue panel 54 (here a reinforcing panel) and reinforcing panel 91 by making horizontal cuts 108,108*b* (the cut 108*b* forming the lower end 59 of the corner support 42*c*) and a vertical cut 110 (forming the end 66) to leave a cut-out 112.

The container is formed into the knockdown state in a manner similar to that described with reference to FIGS. 6 and 7. It is believed that the non-rectangular corner support 42*c*, although less in height that the support corners 42*a* and 42*b* of FIG. 1, provide for a stronger container having a higher stacking strength. Furthermore, it has been found that this container folds easier and runs on packing machines better than containers with the larger height corner supports of 42*a* and 42*b*.

While particular embodiments of the invention are described herein, it is not intended to limit the invention to such disclosure. Changes and modifications may be incorporated and embodied within the scope of the appended claims. Moreover, the designation of "first," "second," etc., for the various panels and members is not limited to the particular panels or members shown herein.

What is claimed is:

1. A container having a corner support, said container comprising:

first, second, third and fourth wall panels, each of said wall panels having an inner face and a top edge, said first and second wall panels being attached to one another at a first corner, said second and third panels being attached to one another at a second corner, said third and fourth wall panels being attached to one another at a third corner, and said first and fourth panels being attached to one another at a fourth corner;

a glue panel attached to said inner face of said first wall panel;

a second glue panel attached to said inner face of said second wall panel;

a first corner support panel section having a first edge attached pivotally and integrally to said glue panel between said first and fourth corners, and having a second edge opposite said first edge and a top edge; and a second corner support panel section having a first edge attached pivotally and integrally to said second glue panel between said first and second corners, said second panel section having a second edge opposite said first edge of said second corner support panel section and a top edge, said second edge of said first panel section and said second edge of said second panel section being attached pivotally and integrally to each other and spaced from said first corner.

2. A container in accordance with claim 1 wherein said top edge of said first panel section is substantially co-elevational with said top edge of said first wall panel.

3. A container in accordance with claim 2 wherein said first and second panel sections have a height substantially less than a height of said first wall panel.

4. A container in accordance with claim 1 wherein said glue panel is integrally attached to and folded about the top edge of said first wall panel.

5. A container in accordance with claim 4 wherein said container is assembleable from a knockdown state having first and second knockdown walls attached to one another at said first and third corners forming a substantially flat assembly, wherein said first knockdown wall includes said first and fourth wall panels in a substantially same plane and said second knockdown wall includes said second and third wall panels in a second substantially same plane, wherein said first and second corner support panel sections are sandwiched between said first and second knockdown walls and folded to be face to face when said container is in the knockdown state.

6. A container in accordance with claim 5 wherein an angle between said first panel section and said first wall panel is greater than 0 degrees and less than 90 degrees.

7. A container in accordance with claim 4 wherein a width between the first and second edges of said first panel section along an outer face of said first panel section is less than a width between the first edge of said first panel section and said first corner of said container along the inner face of said first wall panel.

8. A container in accordance with claim 4 wherein said container is assembleable from a knockdown state having first and second knockdown walls attached to one another to form a substantially flat assembly, wherein said first knockdown wall includes said first and second wall panels in a substantially same plane and said second knockdown wall includes said third and fourth wall panels in a second substantially same plane, wherein said first and second corner support panel sections are substantially coplanar and substantially parallel to said first and second knockdown walls when said container is in the knockdown state.

9. A container in accordance with claim 8 wherein a width between the first and second edges of said first panel section along an outer face of said first panel section is substantially the same as a width between the first edge of said first panel section and said first corner of said container along the inner face of said first wall panel.

10. A container in accordance with claim 8 wherein an angle between said first panel section and said first wall panel is about 90 degrees.

11. A container in accordance with claim 4 wherein said second glue panel is integrally attached to and folded about the top edge of said second wall panel.

12. A container in accordance with claim 4 wherein adhesively attached to the inner face of each of said wall panels is a reinforcing panel.

13. A container, comprising:

first, second, third and fourth wall panels, each of said wall panels having an inner face and a top edge, said first and second wall panels being attached to one another at a first corner, said second and third panels being attached to one another at a second corner, said third and fourth wall panels being attached to one another at a third corner, and said first and fourth panels being attached to one another at a fourth corner;

a glue panel attached to said inner face of said first wall panel;

a second glue panel attached to said inner face of said second wall panel;

a corner support, said corner support having:

a first corner support panel section having a first edge attached pivotally and integrally to said glue panel between said first and fourth corners, and having a second edge opposite said first edge and a top edge;

a second corner support panel section having a first edge attached pivotally and integrally to said second glue panel between said first and second corners, said second panel section having a second edge opposite said first edge of said second corner support panel section and a top edge, said second edge of said first panel section and said second edge of said second panel section being attached pivotally and integrally to each other and spaced from said first corner; and said container being assembleable from a knockdown state having first and second knockdown walls attached to one another at two corners to form a substantially flat assembly, wherein said first and second corner support panel sections are sandwiched between said first and second knockdown walls when said container is in the knockdown state.

14. A container in accordance with claim 13 wherein one of said glue and second panels comprises a reinforcing panel.

15. A container in accordance with claim 13 wherein said glue panel is integrally attached to said top edge of said first wall panel.

16. A container in accordance with claim 13 wherein an angle between said first panel section and said first wall panel is greater than 0 degrees and less than 90 degrees, and a second angle between said second panel section and said second wall panel is greater than 0 degrees and less than 90 degrees.

17. A container in accordance with claim 16 wherein when said container is in the knockdown state, said first and second corner support panel sections are sandwiched between said first and second knockdown walls and folded face to face so as to have an angle of substantially 0 degrees between them.

18. A container in accordance with claim 13 wherein an angle between said first panel section and said first wall panel is about 90 degrees, and said second glue panel is integrally attached to and folded about the top edge of said second wall panel.

19. A container in accordance with claim 18 wherein when said container is in the knockdown state, said first and second corner support panel sections are substantially coplanar and substantially parallel to said first and second knockdown walls.

20. A container in accordance with claim 13 wherein said glue panel is integrally attached to said top edge of said first wall panel, wherein an angle between said first panel section and said first wall panel is greater than 0 degrees and less than 90 degrees, and a second angle between said second panel section and said second wall panel is greater than 0 degrees and less than 90 degrees, and wherein said top edge of said first panel section is substantially co-elevational with said top edge of said first wall panel.

* * * * *